US009858756B2

(12) United States Patent
Gelinotte et al.

(10) Patent No.: US 9,858,756 B2
(45) Date of Patent: Jan. 2, 2018

(54) TOTAL MONEY MANAGEMENT SYSTEM

(71) Applicant: Gaming Partners International Corporation, Las Vegas, NV (US)

(72) Inventors: Emmanuel Gelinotte, Savigny-les-Beaune (FR); Gregory Scott Gronau, Las Vegas, NV (US); Kirsten Clark, Las Vegas, NV (US); Scott McCarthy, Macau (MO)

(73) Assignee: Gaming Partners International USA, Inc., Las Vegas, NV (US)

( * ) Notice: Subject to any disclaimer, the term of this patent is extended or adjusted under 35 U.S.C. 154(b) by 811 days.

(21) Appl. No.: 13/900,413

(22) Filed: May 22, 2013

(65) Prior Publication Data

US 2013/0316797 A1 Nov. 28, 2013

Related U.S. Application Data

(60) Provisional application No. 61/650,423, filed on May 22, 2012.

(51) Int. Cl.

| | |
|---|---|
| ***G07F 17/00*** | (2006.01) |
| ***G07F 19/00*** | (2006.01) |
| ***G07F 17/32*** | (2006.01) |

(52) U.S. Cl.

CPC ..... *G07F 17/3244* (2013.01); *G07F 17/322* (2013.01); *G07F 17/3246* (2013.01); *G07F 17/3248* (2013.01)

(58) Field of Classification Search

CPC ..... G07F 17/322; G07F 17/3244; G07F 17/3246; G07F 17/3248

See application file for complete search history.

(56) References Cited

U.S. PATENT DOCUMENTS 5,651,548 A * 7/1997 French ..... A63F 3/00157 273/237

5,735,742 A 4/1998 French (Continued)

FOREIGN PATENT DOCUMENTS

CN 101176126 A 5/2008
CN 101283382 A 10/2008

(Continued)

OTHER PUBLICATIONS

International Patent Application No. PCT/US2013/042235: International Search Report dated Aug. 9, 2013, 10 pages.

(Continued)

*Primary Examiner* — Milap Shah

(74) *Attorney, Agent, or Firm* — Thomas | Horstemeyer, LLP

(57) ABSTRACT

A total money management system for integrating numerous stand-alone components designed to validate, track and secure gaming currency from the table to back-of-house is provided. Utilizing RFID enabled casino currency, an RFID chip tray, a bill validator, RFID readers and antennas, inventory system and chip authentication network, the total money management system of the present disclosure provides casinos with a cash and chip tracking and reporting tool that will improve table performance and streamline the numerous at-table and back-of-house manual money management processes and procedures.

20 Claims, 2 Drawing Sheets

(56) References Cited

U.S. PATENT DOCUMENTS 5,883,582 A * 3/1999 Bowers ..... G06K 7/0008 340/10.2
7,561,053 B2 * 7/2009 Hecht ..... G07F 17/322 340/572.1
7,938,722 B2 * 5/2011 Rowe ..... A44C 21/00 463/25
2004/0069591 A1 4/2004 Ito
2005/0026680 A1 * 2/2005 Gururajan ..... A63F 1/14 463/25
2006/0258427 A1 * 11/2006 Rowe ..... G07F 17/3237 463/16
2007/0057469 A1 * 3/2007 Grauzer ..... G07F 17/32 273/309
2007/0060307 A1 * 3/2007 Mathis ..... G07F 17/32 463/25
2007/0060311 A1 * 3/2007 Rowe ..... A44C 21/00 463/25
2007/0060313 A1 * 3/2007 Mathis ..... G07F 17/32 463/25
2007/0184898 A1 * 8/2007 Miller ..... G07D 9/002 463/29
2007/0194931 A1 * 8/2007 Miller ..... A63F 1/06 340/572.7
2009/0075723 A1 * 3/2009 Richard ..... G06M 11/00 463/25
2009/0115133 A1 5/2009 Kelly et al.
2009/0239656 A1 * 9/2009 Meyerhofer ..... G07F 17/3241 463/25
2009/0325686 A1 12/2009 Davis et al.
2010/0113140 A1 5/2010 Kelly et al.
2010/0138308 A1 6/2010 Fujita et al.
2010/0167811 A1 * 7/2010 Denham ..... G07F 17/32 463/25
2011/0014963 A1 1/2011 Walker et al.
2011/0065490 A1 3/2011 Lutnick
2011/0204565 A1 * 8/2011 Gelinotte ..... A63F 1/06 273/237

FOREIGN PATENT DOCUMENTS

DE 102007060168 6/2009
WO WO 2006/031918 3/2006
WO WO 2009/088836 A2 7/2009

OTHER PUBLICATIONS

Second Office Action from the State Intellectual Property Office of the People's Republic of China issued for Application No. 201380027072.9 dated Apr. 12, 2017.

* cited by examiner

TOTAL MONEY MANAGEMENT SYSTEM

CROSS REFERENCE TO RELATED APPLICATIONS

This application claims benefit under 35 U.S.C. §119(e) of Provisional U.S. Patent Application No. 61/650,423, filed May 22, 2012, the contents of which is incorporated herein by reference in its entirety.

TECHNICAL FIELD

This disclosure generally concerns a total money management system for integrating several stand-alone components designed to validate, track (account for) and secure gaming currency from the table to back-of-house.

BACKGROUND

Automated accounting system that automatically monitor and record gaming currency transactions within a casino are known. See, for example, U.S. Pat. No. 5,735,742, issued to French, which describes a system for tracking chips. While such systems are employed at tables and cashier cages and serve the purpose of assuring the accuracy of chip transactions, such systems only account for one side (i.e., the chip side) of any transaction involving cash, such as bills and coins, and do not account for the accuracy or validity of the cash side of the transaction. In other words, such systems are one sided and do not include proper checks and balances.

Such automated tracking systems are also dependent upon dealers, cashiers and the like to handle and count the chips for acceptance from a customer or payout to a customer, even if the chips are read electronically in some way. The physical handing of chips by people as part of the process can lead to mistakes and fraud.

SUMMARY

A total money management system for integrating numerous stand-alone components into a singular system that validates, tracks (account for) and secures gaming currency and cash from the table to back-of-house. Specifically, a total money management system comprises a radio frequency identification (RFID) chip tray for storing RFID enabled casino currency, a bill validator for receiving currency from a casino patron, a gaming chip recycler, and a plurality of RFID readers and antennas. The system also comprises an inventory system and a chip authentication network coupled to the bill validator and the plurality of RFID readers and antennas. The inventory system and chip authentication network are configured for interfacing with the bill validator, the gaming chip recycler, and the RFID chip tray to balance transactions, track all cash and chip movement, authenticate all incoming and outgoing chips, process fills and credits, alert casino management when specified incidents occur, and relay all data to the casino management system.

In accordance with another aspect of the present disclosure, a method of using a total money management system for validating, tracking and securing gaming currency from a gaming table to the back-of-house is provided. The method comprises the operator of the total money management system, i.e., a dealer or cashier receiving a cash buy-in comprising one or more bank notes from a patron or customer. The patron or dealer inserts the bank notes into a bill validator. The bill validator is responsible for counting and authenticating all incoming bank notes and then securely storing them in a below-table stacker until the table is closed. The bill validator is also configured for sharing with an inventory system the following data points: number of bills accepted, number of bills rejected, and the total value of notes in stacker. In operation, the bill validator authenticates and counts the accepted notes, and rejects any questionable items. Next, the amount of the bank notes is displayed to the player so that the player may accept or reject the displayed amount.

The dealer then removes the corresponding amount of RFID enabled chips from the chip tray and places them on the table authentication/validation antenna. The chip tray is typically responsible for balancing cash-in/chip-out transactions, tracking all other chip purchase transactions, and communicating with the inventory system to provide ongoing transaction data and balances which would provide operations with real time floor figures. The inventory system reconciles the cash buy-in sent from the bill validator with the RFID enabled chips placed on the antenna and, if the amounts balance, drops the bank notes into a stacker. Alternatively, a chip recycler may be used to count out the appropriate number of RFID enabled chips and dispense such chips directly to the player.

The foregoing and other features, utilities and advantages of the disclosure will be apparent from the following more particular description of various embodiments of the disclosure as illustrated in the accompanying drawings and claims.

DETAILED DESCRIPTION OF ILLUSTRATIVE EMBODIMENTS

As used herein, the expression "gaming currency" refers to any chip, plaque, or jeton that may be used in a casino or gaming room, and that represents a value that is predetermined or not. Gaming currency is typically made of a rigid plastic material or clay to obtain a structure that is solid enough to resist conditions of use in casinos, which are often very tough. Gaming currency, also referenced herein as "chips" may be used throughout a casino. For example, at gaming tables, chips may be received for play or the conclusion of a game or hand, cash may be received and chips paid out (chips buy-in), and chips may be paid out during play. In a cashier area, chips are received and cash is paid out (cash out) or cash is received and chips are paid out (chips buy-in). Typically, such chip transactions, also referred to as "chip recycling," is manual in that the dealer or croupier takes the chips and stores them in a chip tray or table float area. When chips need to be paid out or there is a color in transaction (where chips of one or more denominations, i.e., large value chips, are exchanged for chips of one or more other denominations, i.e., lower value chips), the chips are manually removed from the chip tray or table gloat and used.

Figure 1:
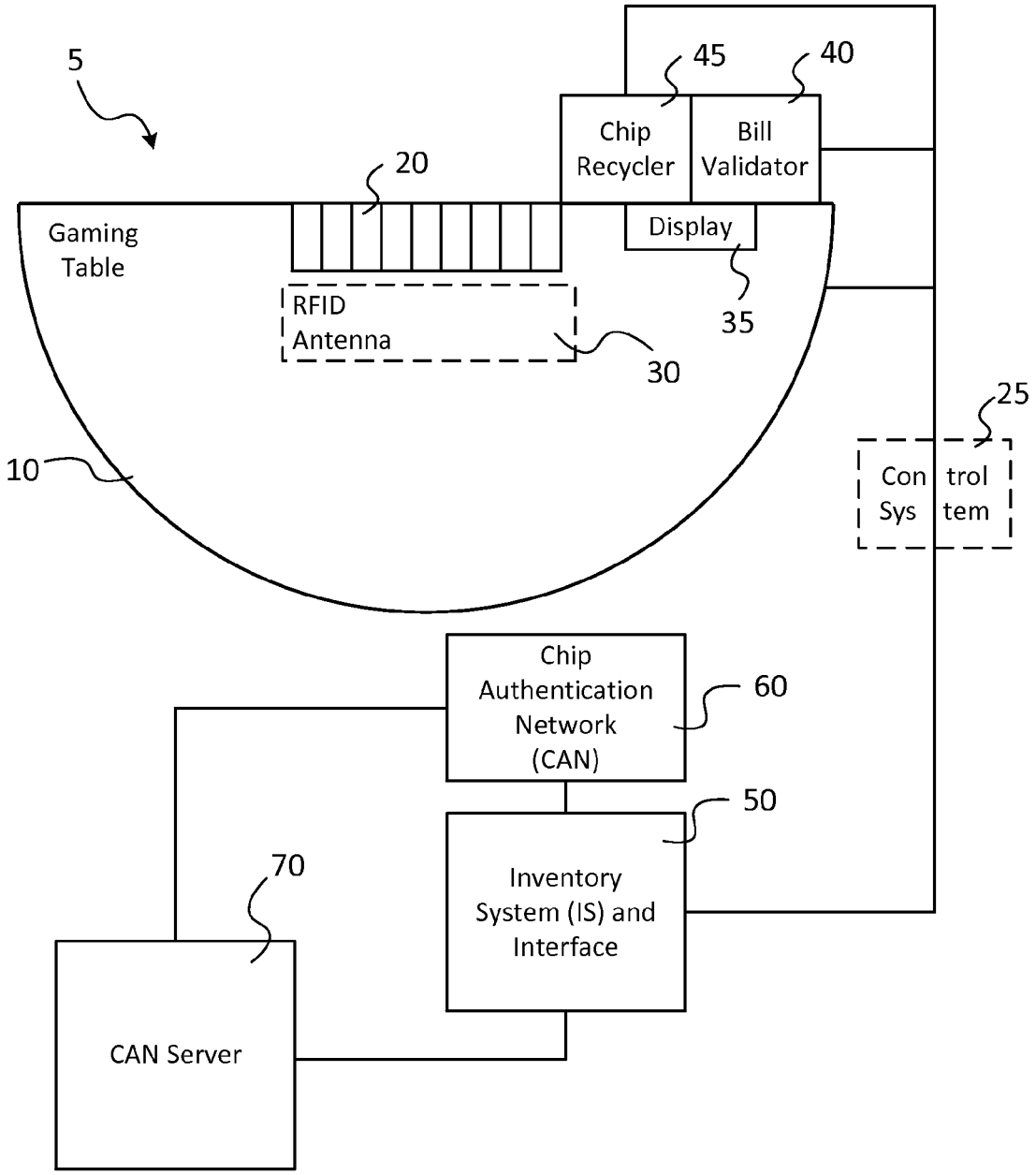
FIG. 1 illustrates an embodiment of a total money management system having an RFID enabled gaming table, chip recycler, and a bill validator coupled to an Inventory System (IS) and Chip Authentication Network (CAN)

FIG. 1 illustrates the total money management system 5 in accordance with one aspect of the present disclosure. An RFID enabled gaming table 10 is coupled to a bill validator 40 and a chip recycler 45, which are both connected to an Inventory System (IS) 50 and Chip Authentication Network (CAN) 60 in accordance with one aspect of the present disclosure. Combining the efficiencies of RFID gaming currency, with an RFID enabled gaming table, with a high-speed table bill validator 40 and/or chip recycler 45, the present RFID total money management system 5 streamlines table game cash and chip transactions to enable an increase in rounds per hour while providing increased currency and chip security through instant authentication and validation.

RFID enabled gaming tables generally include one or more areas of the table in which antennas for communicating with RFID gaming currency are applied, embedded or otherwise installed and include one or more readers (either as part of the table or part of the control system 25) for reading identification and value information from gaming currency placed within the areas covered by the antennas. As shown in FIG. 1, in order to simplify the drawings, gaming table 10 only depicts a single RFID antenna and reader 30 covering an area of the layout of the gaming table 10, but multiple antennas could be installed throughout the gaming table 10. Such antennas may be optionally controlled by an internal control system or reader or an external control system 25 that includes readers, such as illustrated in FIG. 1, which is connected to and in communication with the gaming table 10. Information collected from the gaming currency is communicated by the antennas/readers and/or the control system 25 to the IS 50. As shown in FIG. 1, control system 25 is illustrated by a dotted line to indicate its optional location.

Gaming table 10 may also include a display 35 for displaying cash-in values determined by the bill validator (which may include its own display that could be used in place of the display 35) and chip-out values determined by the chip tray 20 or the antenna and reader 30.

Bill validator 40, such as the "iV8" table game bill validator, manufactured by JCM Global, is a device that determines whether non-gaming currency, i.e., bills, are genuine or counterfeit, determines the value of each bill, and tabulate a total value of bills input to the validator. Systems such as the iV8 may provide instant validation of up to eight banknotes per second of varying denominations and possibly even different types of currency. When a patron or player approaches a table or a cashier cage and puts cash down to play, the dealer/cashier will insert the bills into an adjoining tray (intake area) of the validator 40 and the validator will authenticate and count the bills. Validated bills are output to an escrow tray and rejected bills are output to a reject tray so they can either be input again or returned to the player. Once bills are accepted, as further discussed below, the cash is stored within a stacker in the validator 40, which is subsequently removed and sent to a counting room.

Chip recycler 45 may operate in much the same fashion as a coin recycler and may be used in place of chip tray 20. At the end of game or hand, if a dealer has collected chips from players, the chips may be placed into an input area, such as a funnel, hopper or tube, and then validated (authenticated), counted, sorted and stored by the recycler. If chips were to be paid out to players, or in exchange for cash, or exchanged for other chips, then logic within the gaming table 10 or from a table management system or the control system 25, may instruct the chip recycler 45 how much in chips and which denominations to pay out. A chip recycler 45 within a cashier cage, a bank or vault, or kiosk might operate in a similar fashion. A user places the chips in the recycler 45, the recycler processes the chips and either automatically outputs chips in other denominations or outputs cash equal to the input chip value.

The total money management system 5 provides casinos with a cash and chip tracking and reporting tool that will improve table performance and streamline the numerous at-table and back-of-house manual money management processes and procedures required. As shown in FIG. 1, the IS 50 and CAN 60 interface with the bill validator/cash drop 40, chip recycler 45, table chip tray 20, and RFID antenna and reader 30 to balance transactions, track all cash and chip movement, authenticate all incoming and outgoing chips, process fills and credits, alert casino management when specified incidents occur and relay all data to the casino management system (not shown), which is connected to the IS 50 and CAN 60. The IS 50, within the context of the total money management system 5, provides the following:

1. Increasing protection against counterfeiting and theft by validating or rejecting invalid or unrecognized chips and by alerting management if a significant number of invalid/suspicious bank notes have been inserted into the bill validator;
2. Alerting casino staff if table inventory levels have risen above/fallen below the casino's desired par level amounts;
3. Reducing or eliminating numerous manual counting processes and procedures while eliminating human error and reducing fraud;
4. Providing chip volume and tracking data that can be used to evaluate floor performance and staffing needs based on chip movement;
5. Eliminating manual balance/inventory entries when interfaced with a Cash Management System (CMS); and
6. Automate end of shift/end of day reporting by "taking a picture" of stacker and tray balances and providing this information to CMS for reconciliation.

Gaming table 10 is provided with a chip tray 20 and RFID antenna and reader 30. Using an RFID chip tray or float reader, a casino property may automate and perfect chip counting procedures, enabling staff and pit supervisors to focus on other tasks. The present disclosure offers the following options for both low and high frequency chips: Single Level Chip Tray, Dual Level Chip Tray and Roulette Float Reader. Each RFID-enabled casino chip, plaque or jeton has a unique tag that is encoded with its monetary value, it can be instantly identified and validated when it comes in contact with an RFID reader. This makes RFID currency an ideal way to improve the accuracy of chip counting and cage inventory procedures while also providing a casino property with a level of currency security that is practically impossible to breach. Chip recycler 45 can also identify and validate chips, which combined with the RFID enabled gaming table 10, adds a further layer of security and checks and balances within the casino.

Using RFID technology to track the location and status of all RFID enabled chips throughout a casino property, the IS of the present disclosure may help increase inventory movement efficiency and security and gain valuable insight into casino operations. By tracking casino currency from the cage or vault to its authorized location on the gaming floor, it may allow real-time monitoring and authentication of inventory and provide instant and accurate validation of chip amounts and serial numbers. This information means a casino will know what is going on with its chips at all times and possible to have an instantaneous report of money flow within the casino, instead of having to wait the 12 to 24 hours typically required to get a comprehensive report.

A few key benefits of the IS system include the following:

1. Automated chip management eliminates manual processes, minimizes human errors and improves overall efficiency;
2. Software-based interfaces enhances usability and provides immediate access to a complete and accurate database of all valid chips and their individual attributes;
3. Enables chip validation and authentication from any location;
4. Increases protection against chip counterfeiting and theft;
5. Increases the accuracy of chip cash in and out transactions by verifying manual counts (when chip recycling is not in use);
6. Provides a secure inventory of chips;
7. Enables secure chip material receiving;
8. Verifies proper location of each chip;
9. Monitors the activity of the chip tray (lids and locks), when chip trays are used;
10. Full integration possible with third-party table management systems;
11. Provides chip information to surveillance systems, if integrated;
12. Provides a wide list of possible reports; and
13. Includes the latest technologies for antennae and readers.

The IS is typically comprised of three software applications: the IS interface 50, the CAN client 60 and the CAN Server 70. The IS is an easy-to-use tool that does more than simply track and protect casino currency. By connecting with back-of-house managing systems through CAN server 70, this tool provides automated control of live table games in real time. With its ease of connectivity to one or more third-party CAN subscribers, users gain access to accurate information from anywhere inside the casino. With IS, the chip information integrates seamlessly through the CAN server 70 with any third-party operating system so that one obtains absolute control of casino currency at all times. The system's real-time monitoring and authentication of inventory provides instant and accurate validation of chip amounts and serial numbers, and is then linked automatically to any third-party system, including table management systems.

The programs are installed on a casino operator's servers/control systems 25 and are protected by the casino's standardized IT controls to ensure physical security and data integrity. The RFID chip inventory, the actual database of the casino operator's RFID programmed chips, which are each identified by a unique, one-of-a-kind, serial number assigned to each chip along with proprietary manufacturing information, is entered into the IS. The chips are "read" into the database via a commissioning process that validates the chips against the database using encryption to ensure absolute integrity. Once the chip inventory is complete, purpose-suited readers and antennas can be installed in any desired location, including cages, vaults/banks, gaming tables, and more. As the chips move between the RFID chip-reading systems in each of these locations, the chips are accounted for along the way. This data detailing each chip's movement throughout a casino property is available for analysis using numerous reports that could be generated by the IS 50 and CAN 60/CAN Server 70.

The comprehensive RFID chip management system of the present disclosure provides a casino property with the highest level of operational insight, efficiency and security available. Its real-time validation and reporting functionality provides instant access to all chip activity taking place in the cage, back office (vault/bank) and on the floor. One or more chips and money changing kiosks could also be connected to the IS 50 and/or total money management system 5. Such kiosks may include chip recyclers combined with bill validators and may be used to replace cages and cashiers in many cases. Such kiosks may enable players to pay with cash, credit cards and other types of vouchers, such as ticket-in, ticket-out (TITO) cards or tickets, and receive chips in exchange, or input chips and get cash in exchange. All such kiosks transactions and the movement of the chips and cash would be reported to and monitored by the IS 50 and total money management system 5.

By integrating numerous stand-alone components designed to validate, track and secure casino currency from the table to back-of-house, the total money management system 5 of the present disclosure provides casinos with a significant return on investment by: (1) enabling an increase in table game rounds per hour, (2) providing greater currency security through instant authentication and validation, (3) reducing or eliminating manual counting processes and procedures, and (4) providing labor savings and accounting efficiencies.

Figure 2:
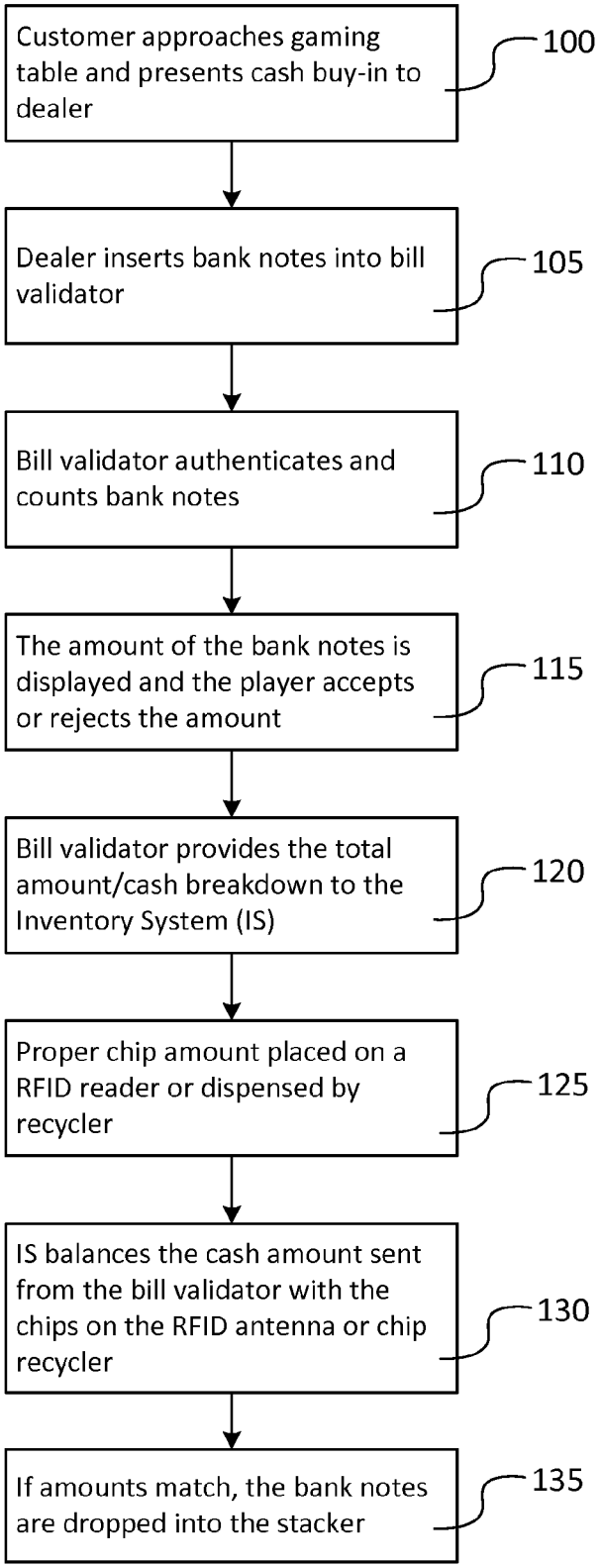
FIG. 2 illustrates an embodiment of a flowchart of the operation of the system of FIG. 1.

FIG. 2 shows the operation of the total money management system 5 in accordance with one embodiment. At step 100, a customer approaches the gaming table 10 and presents a cash buy-in to the dealer. At step 105, the dealer inserts notes into bill validator 40. As the first step in the buy-in process, the high-speed bill validator 40 is responsible for rapidly counting and authenticating all incoming notes and then securely storing them in a below-table stacker until the table is closed. In one embodiment, the bill validator 40 is responsible for sharing with IS 50 the following data points: number of bills accepted, number of bills rejected, and the total value of notes in stacker.

The bill validator 40 authenticates and counts the accepted notes, and rejects any questionable items, as shown in step 110. The amount of the bank notes is displayed by the bill validator 40 or a separate display 35, and the player accepts or rejects the displayed amount in step 115. At step 120, the bill validator 40 provides the total amount/cash breakdown to the IS 50. Continuing with step 125, the proper chip amount is then placed on the RFID reader 30 by the dealer or automatically dispensed by the chip recycler 45. If chips are recycled manually, the dealer would remove the proper amount of corresponding RFID enabled chips from the chip tray 20, which also may include an RFID reader/antenna and place them on the table authentication/validation antenna and reader 30. As the second step in the buy-in process, the components responsible for tracking all chip-based transactions during the table open period, such as the RFID chip trays 20, antenna and reader 30 and chip recycler 45, may automate and track chip tray inventory. In one embodiment, the total money management system's primary responsibilities include: balancing cash buy-in and chip-out transactions, tracking all other chip purchase transactions, and communicating with IS 50 to provide ongoing transaction data and balances which would provide operations with real time floor figures.

At step 130, the IS balances the cash amount sent from the bill validator with the chips set on the antenna, or dispensed by the chip recycler 45. In an alternate embodiment, IS may also show a validation button used to accept the transaction. If the in/out amounts are different, the button won't appear. At step 135, when the amounts balance, the bills are dropped into the stacker.

Some areas of the casino property that are positively affected include:

At the table

1. Increase rounds per hour and overall table win per day by reducing and/or eliminating labor intensive manual counting procedures required by automating counting and/or validating procedures;
2. Eliminate manual counting errors;
3. "Close the cash management loop" by providing an integrated solution that automatically balances cash in and chips out transactions while providing ongoing data about the money in the drop box and chip float;
4. Automate table fills and credits while synchronizing these transactions with chips coming in and going out of the fill bank; and
5. Automate table and shift open and close procedures by providing instantaneous float and drop box balances and sharing this information with the casino management system.

Back-of-house

1. Eliminate manual counting errors and procedures in cage and count areas;
2. Eliminate manual inventory and cash balance entries into the casino management system;
3. Automate fill and credit manual accounting procedures;
4. Enable real-time remote monitoring of table cash and chip balances; and
5. Enable real-time remote monitoring and accounting of cage and fill bank transactions.

Accounting & Reporting Efficiencies

1. Provide immediate, automated access to open table cash and chip tray balances and enable immediate end-of-shift accounting of table balances;
2. Reduce or eliminate supervisory reporting process and procedures; and
3. Increase reporting transparency for cash and chip transactions.

The particulars shown herein are by way of example and for purposes of illustrative discussion of the embodiments of the present disclosure only and are presented in the cause of providing what is believed to be the most useful and readily understood description of the principles and conceptual aspects of the present disclosure. In this regard, no attempt is made to show structural details of the present disclosure in more detail than is necessary for the fundamental understanding of the present disclosure, the description taken with the drawings making apparent to those skilled in the art how the several forms of the present disclosure may be embodied in practice. Many alterations and modifications of the present disclosure will no doubt become apparent to a person of ordinary skill in the art after having read the foregoing description.

It is noted that the foregoing examples have been provided merely for the purpose of explanation and are in no way to be construed as limiting of the present disclosure. While the present disclosure has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present disclosure in its aspects. Although the present disclosure has been described herein with reference to particular means, materials and embodiments, the present disclosure is not intended to be limited to the particulars disclosed herein; rather, the present disclosure extends to all functionally equivalent structures, methods and uses, such as are within the scope of the appended claims.

What is claimed:

1. A money management system, comprising:

a plurality of bill validators, wherein each of the plurality of bill validators is configured to receive a first type of non-gaming currency from a patron of a casino and generate a cash-in value for the first type of non-gaming currency, wherein the cash-in value is to be exchanged by an operator for an equal chip-out value of Radio Frequency Identification (RFID) enabled gaming currency to be provided to the patron;

a plurality of gaming tables, wherein each of the plurality of gaming tables includes an inventory of the RFID enabled gaming currency and an RFID antenna and reader, the RFID antenna and reader being configured to read a first set of identification information and value information for one or more of the RFID enabled gaming currency to be removed by the operator from the inventory, the one or more of the RFID enabled gaming currency corresponding to a chip-out value equal to the cash-in value, the RFID antenna and reader generating the chip-out value; and an inventory system coupled to each of the plurality of bill validators and each of the plurality of gaming tables including the RFID antenna and reader, the inventory system configured to:

monitor and track a currency inventory of the casino;

receive the cash-in value, the chip-out value, and the first set of identification information and value information;

verify that the cash-in value matches the chip-out value;

authorize acceptance of the first type of non-gaming currency within each of the plurality of bill validators;

authorize payment of the one or more RFID enabled gaming currency to the patron; and account for all of the currency inventory flowing throughout the casino based on the first set of identification information and value information, wherein the currency inventory includes the inventory and a second type of non-gaming currency exchanged with the casino, wherein the second type of non-gaming currency is different from the first type of non-gaming currency.

2. The money management system of claim 1, wherein the RFID antenna and reader of each gaming table is further configured to receive RFID enabled gaming currency not included in the inventory and to read a second set of identification information and value information from the RFID enabled gaming currency not included in the inventory, further comprising a chip authentication network coupled to the inventory system and configured to administer the inventory system and to verify authenticity of the RFID enabled gaming currency not included in the inventory based on the second set of identification information and value information, wherein the inventory system is further configured to account for all of the currency inventory based on the second set of identification information and value information.

3. The money management system of claim 2, wherein the RFID antenna and reader of each gaming table is further configured to read a third set of identification information and value information from the RFID enabled gaming currency included in the inventory that will be paid to a patron at a completion of a game or hand and to provide the inventory system with an account of the inventory based on the third set of identification information, wherein the inventory system is further configured to account for all of the currency inventory based on the third set of identification information and value information.

4. The money management system of claim 1, wherein each gaming table includes a display configured to display the cash-in value and the chip-out value.

5. The money management system of claim 1, wherein each gaming table includes a chip tray for holding the inventory, wherein the RFID antenna and reader is further configured to read a second set of identification information and value information from the RFID enabled gaming currency included in the chip tray, further comprising a chip authentication network coupled to the inventory system and configured to administer the inventory system and to verify an authenticity of the RFID enabled gaming currency in the chip tray, wherein the inventory system accounts for all of the currency inventory based on the second set of identification information and value information.

6. The money management system of claim 5, wherein the RFID antenna and reader of each gaming table is further configured to receive RFID enabled gaming currency not included in the inventory and to read a third set of identification information and value information from the gaming currency not included in the inventory, wherein the chip authentication network is configured to verify the authenticity of the RFID enabled gaming currency not included in the inventory based on the third set of identification information and value information, and wherein the inventory system is further configured to account for all of the currency inventory based on the third set of identification information and value information.

7. The money management system of claim 6, wherein the RFID antenna and reader of each gaming table is further configured to read a fourth set of identification information and value information from the RFID enabled gaming currency included in the inventory that will be paid to a patron at a completion of a game or hand, and wherein the inventory system is further configured to account for all of the currency inventory based on the fourth set of identification information.

8. The money management system of claim 1, further comprising:

a plurality of chip recyclers, wherein each chip recycler is configured to:
- hold the inventory at each gaming table;
- receive RFID enabled gaming currency not included in the inventory; and
- read a second set of identification information and value information from the gaming currency not included in the inventory;

a chip authentication network coupled to the inventory system and configured to:
- administer the inventory system; and
- verify an authenticity of the gaming currency not included in the inventory based on the second set of identification information and value information; and wherein the inventory system is further configured to account for all of the currency inventory based on the second set of identification information and value information.

9. The money management system of claim 1, wherein the plurality of bill validators are further configured to receive a plurality of non-gaming currency from a plurality of patrons and to exchange the plurality of non-gaming currency for a plurality of RFID enabled gaming currency of equal value to be provided to the patron, further comprising a plurality of RFID antennas and readers configured to read identification information and value information from RFID enabled gaming currency throughout the casino in which each of the gaming tables resides, and wherein the inventory system is coupled to the plurality of bill validators and the plurality of gaming tables including RFID antennas and readers and is configured to monitor and track the currency inventory.

10. The money management system of claim 8, wherein the plurality of chip recyclers are configured to hold at least a portion of the currency inventory, and to exchange a portion of the currency inventory for the plurality of non-gaming currency received by the plurality of bill validators, and wherein the inventory system is coupled to the plurality of chip recyclers to monitor and track the currency inventory.

11. The money management system of claim 10, wherein the plurality of bill validators, the plurality of gaming tables including RFID antennas and readers, and the plurality of chip recyclers are located throughout the casino to enable the inventory system to:
- balance all of the currency inventory;
- track all of the currency inventory;
- authenticate all incoming and outgoing RFID enabled gaming currency;
- process all fills and credits of non-gaming currency and RFID enabled gaming currency;
- alert casino management when predetermined incidents occur; and
- relay all data collected by the inventory system to casino management.

12. The money management system of claim 1, wherein the currency inventory includes at least one of: chips, cash, casino vouchers, and casino tickets.

13. The money management system of claim 12, wherein cash includes at least one of: coins and bank notes.

14. The money management system of claim 1, further comprising a plurality of RFID antennas and readers positioned throughout the casino, wherein the plurality of RFID antennas and readers provide the inventory system with data indicating movement of the currency inventory throughout the casino.

15. The money management system of claim 1, wherein the RFID antenna and reader is further configured to reject unauthenticated chips.

16. A method comprising:

receiving, via one of a plurality of bill validators, a first type of non-gaming currency from a patron of a casino;

generating, via one of the plurality of bill validators, a cash-in value for the first type of non-gaming currency, wherein the cash-in value is to be exchanged for an equal chip-out value of RFID enabled gaming currency to be provided to the patron;

reading, via an RFID antenna and reader of one of a plurality of gaming tables, a first set of identification information and value information for one or more of the RFID enabled gaming currency to be removed from an inventory, wherein the one or more RFID enabled gaming currency corresponds to a chip-out value equal to the cash-in value, the RFID antenna and reader generate the chip-out value, and each of the plurality of gaming tables includes the inventory of the RFID enabled gaming currency and the RFID antenna and reader;

monitoring and tracking, via an inventory system coupled to the plurality of bill validators and the plurality of gaming tables, a currency inventory of the casino;

receiving, via the inventory system, the cash-in value, the chip-out value, and the first set of identification information and value information;

verifying, via the inventory system, that the cash-in value matches the chip-out value;

authorizing, via the inventory system, acceptance of the first type of non-gaming currency within each of the plurality of bill validators;

authorizing, via the inventory system, payment of the one or more RFID enabled gaming currency to the patron; and accounting, via the inventory system, for all of the currency inventory flowing throughout the casino based on the first set of identification information and value information, wherein the currency inventory includes the inventory and a second type of non-gaming currency exchanged with the casino, wherein the second type of non-gaming currency is different from the first type of non-gaming currency.

17. The method of claim 16, wherein the currency inventory of the casino excludes gaming currency that is not RFID enabled.

18. The method of claim 16, further comprising providing, via one of the plurality of bill validators, the cash-in value for the first type of non-gaming currency to the inventory system.

19. The method of claim 16, further comprising authenticating, via one of the plurality of bill validators, the first type of non-gaming currency.

20. The method of claim 16, further comprising dropping, via one of the plurality of bill validators, the first type of non-gaming currency into a stacker in response to acceptance of the first type of non-gaming currency being authorized.

* * * * *